United States Patent [19]

MacNamara

[11] Patent Number: 5,074,432

[45] Date of Patent: Dec. 24, 1991

[54] CARD DISPENSING DEVICE

[76] Inventor: Barry A. R. MacNamara, 8 Deverton Court, Carindale, Brisbane, Queensland, Australia, 4152

[21] Appl. No.: 557,181

[22] Filed: Jul. 24, 1990

[51] Int. Cl.[5] ..... B65H 3/44; G07F 11/00

[52] U.S. Cl. ..... 221/131; 221/242; 221/273; 271/144

[58] Field of Search ..... 271/131, 137, 144; 221/272-275, 241-242, 131, 124; 74/53-55; 453/41, 44-47

[56] References Cited

U.S. PATENT DOCUMENTS

| | | | |
|---|---|---|---|
| 3,298,570 | 1/1967 | Skorey et al. | 221/272 |
| 3,445,035 | 5/1969 | Ackerman . | |
| 3,888,129 | 6/1975 | Velan et al. | 74/55 |
| 4,077,188 | 3/1978 | Strombeck et al. | 221/273 |
| 4,526,264 | 7/1985 | MacNamara et al. . | |
| 4,590,812 | 5/1986 | Brackett | 74/55 |
| 4,690,303 | 9/1987 | Draper et al. | 221/241 |

*Primary Examiner*—H. Grant Skaggs

*Attorney, Agent, or Firm*—Renner, Otto, Boisselle & Sklar

[57] ABSTRACT

A card dispensing mechanism for an automatic card dispensing machine is provided with adjustable walls for storing cards of different lengths and interchangeable card ejecting device which can be selected to dispense cards of a preselected length. The card ejecting device may be adjusted to operate on cards of different thickness.

11 Claims, 2 Drawing Sheets

CARD DISPENSING DEVICE

BACKGROUND OF THE INVENTION

The present invention relates to automatic coin actuated card or ticket dispensing machines. More particularly it concerns a card or ticket dispensing device whereby the dispensing machine may dispense cards or tickets of different sizes. The term "coin" is used herein to include tokens, paper currency and devices for obtaining credit such as credit cards while the terms "card" or "ticket" include like articles.

DISCUSSION OF THE PRIOR ART

Coin actuated machines for dispensing cards or tickets are well-known. U.S. Pat. No. 4,526,264 (McNamara and Garde) discloses an automatic coin actuated card dispensing machine including a mechanism ejecting a lowermost card from a stack comprising a flat slide plate reciprocally sliding in rails surrounding the side edges of the plate. The rear end of the plate is formed with an upwardly extending portion to operate a microswitch handle and which is connected to a pair of motor operated eccentric arms. U.S. Pat. No. 3,445,035 (Ackerman) discloses an automatic coin actuated card dispensing machine for dispensing a predetermined number of cards from columns of stacked cards in which the card dispensing mechanism comprises a number of card pusher plates located at the plane of the lowermost cards with each pusher plate being connected to a solenoid by a link whereby the pusher plates may be moved rearwardly of the stacks. Cams located on a common camshaft are arranged to engage the rear edge of each retracted pusher plate and on rotation to move the retracted pusher plate forward to eject the lowermost card from each stack for which its associated pusher plate has been retracted.

SUMMARY AND OBJECTS OF THE INVENTION

Prior constructions of coin operated card dispensing machines have been directed to providing more efficient and more reliable machines. However, such known machines are capable only of dispensing cards or tickets using ticket ejecting devices which are only capable of operating on tickets or cards of a specific. uniform size notwithstanding that different machines may be capable of dispensing tickets or cards of a size different from those dispensed from another machine.

It has been found that the users of card or ticket dispensing machines have a strong predilection for tickets of a particular size which size differs between various user groups. In the past, this problem has been met by providing card or ticket dispensing machines which dispense cards or tickets of the size acceptable to a particular user group.

Unfortunately, this preference on the part of users has required the manufacture of ticket dispensing machines designed for a specific user group. Machines designed for cards of one size have tended not to be patronised by user groups familiar with a different sized card and prior machines have not been constructed so as to be able to be modified to dispense cards of different sizes.

The present invention intends to overcome the above problem by enabling a coin-operated card or ticket dispensing machine to dispense cards or tickets of a number of different sizes, the size being selected by the user.

Moreover, prior card or ticket ejecting mechanisms involve constructions which require complex operating mechanisms and which are not interchangeable. The present invention is intended to provide a construction of card or ticket dispensing device in which the card or ticket ejecting means may be modified to dispense cards or tickets of different sizes.

The above and other objects and advantages of the present invention will become apparent from the following description.

STATEMENT OF THE INVENTION

Broadly, the present invention comprises a card or ticket dispensing device for a coin-operated card or ticket dispensing machine, said device comprising a pusher plate support assembly comprising a plurality of parallel, substantially horizontal, spaced pairs of guides with each pair of guides being disposed between means including a pair of spaced parallel side walls for slidably retaining a column of vertically superposed substantially horizontal tickets or cards for downward movement of said cards or tickets and a ticket or card pusher plate assembly detachably and slidably supported on each said pair of guides for horizontal reciprocatory movement along said pair of guides, each pusher plate assembly comprising a pusher plate having guide engaging means for engaging a pair of guides, a forwardly facing, upwardly extending flange for engaging the rear edge of the lowermost card or ticket stored in the column above said pair of guides and an arm extending rearwardly of said pusher plate and including engaging means at its rear end for releasably engaging eccentric actuating means for reciprocating said pusher plate assembly to eject the lowermost card or ticket from the column disposed above said pusher plate assembly, each said pusher plate assembly and the associated actuating means being arranged such that the distance between the upwardly extending flange on said pusher plate assembly and the axis of rotation of its eccentric actuating means is selected to eject a card or ticket of a particular predetermined length.

In a preferred form of the invention, the means for retaining each column of cards or tickets includes a rear wall which can be adjustably positioned on the associated pair of side walls.

Suitably, the upwardly extending flange may be located on the upper surface of the pusher plate. The flange may be formed as the forward edge of a plate adjustably mounted on the pusher plate whereby the height of the flange may be adjusted with this arrangement, the height of the flange may be varied to correspond to different thicknesses of cards or tickets to be dispensed.

DESCRIPTION OF THE DRAWINGS

In order to enable the invention to be more readily understood, reference is made to the accompanying drawings of which

FIGS. 2 and 3 are fragmentary illustrations of a ticket dispensing device according to the invention for dispensing cards or tickets of three different lengths.

Description of Preferred Embodiment

Figure 1:
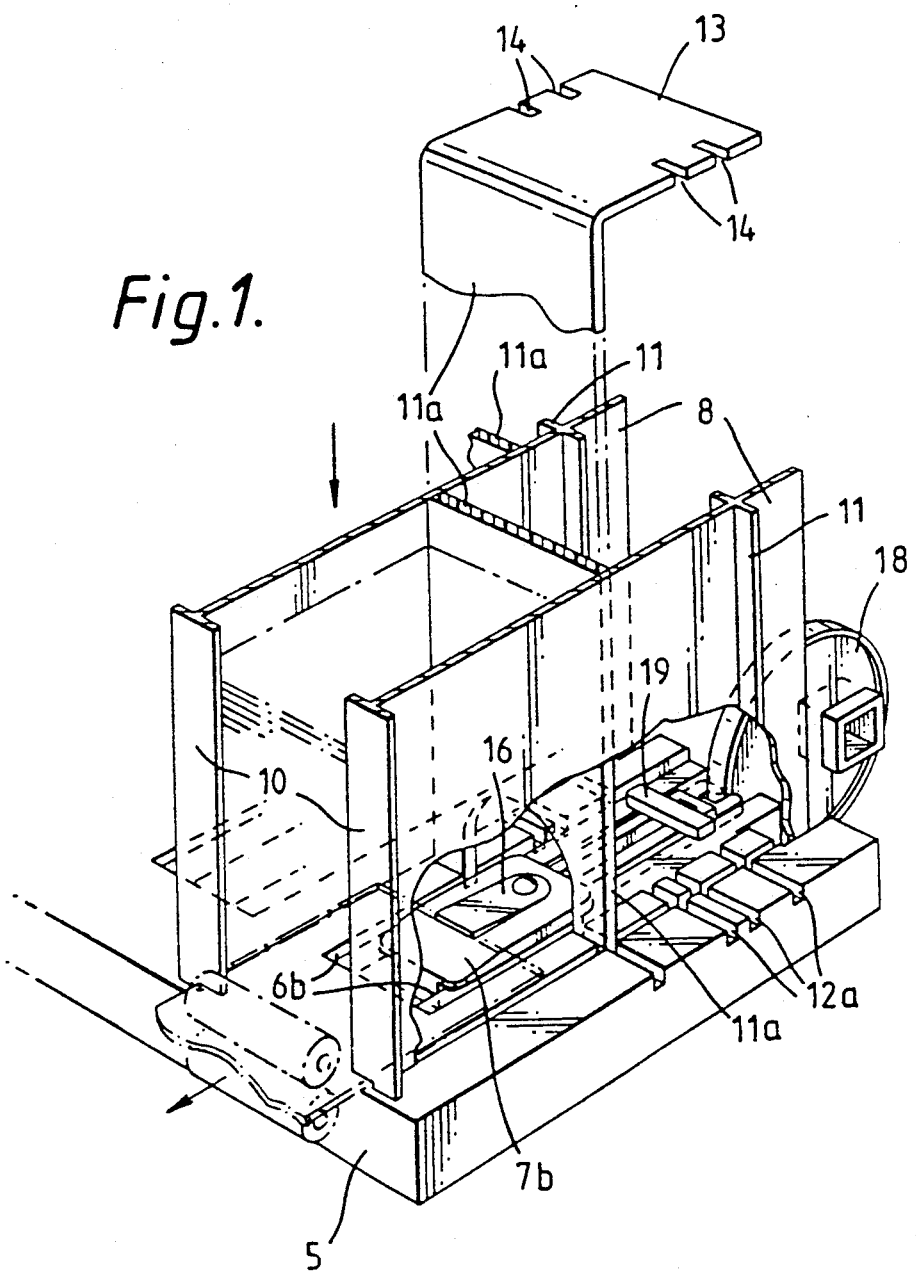
FIGURE 1 is a fragmentary perspective view of a card dispensing device according to the present invention for a single column of cards.

As illustrated the ticket dispensing device according to a preferred form of the invention comprises a pusher plate support plate 5 of which 3 pairs of guides 6, 6*a*, 6*b* are shown. Guides 6, 6*a* and 6*b* slidably support ticket pusher plates 7, 7*a* and 7*b*. Each pusher plate is disposed between abutting pairs of parallel column walls 8 which may be located in slots 9 formed in support plate 5. Each column wall 8 is formed at its forward edge with ribs 10 which act to retain cards in a vertical column. Ribs 10 are recessed at their lower ends to allow ejection of the lowermost card in the column. Each pair of column walls 8 is also provided with opposed rear ribs 11 which project inwardly of the respective column. Ribs 11 may form a real wall for a column of cards or tickets of the longest length intended to be dispensed. Ribs 11 may be located in groove 12 formed in the support plate 5. In order to support columns of cards or tickets of one or more shorter length an adjustable rear wall 11*a* is provided having a rearwardly extending upper flange 13 provided with one or more opposed pairs of slots 14. The lower end of wall 11*a* is provided with an upwardly extending access to allow passage of the pusher plate. The lower end of wall 11*a* is appropriately located in one of grooves 12*a* formed in support plate 5. Conveniently column walls 8 and ribs 10, 11 are formed as a metal extrusion and constructed as a module to dispense, for example, cards or tickets from a predetermined number of columns.

Pusher plates 7, 7*a* and 7*b* each comprise a body 14 suitably having a longitudinal recess 15 on its upper surface. Located in recess 15 is plate 16 the forward edge of which projects above body 14 to provide a flange adapted to engage the rear edge of the lowermost card in the column located in the column above the pusher plate. Desirably, the height of the flange is adjustable which adjustability may be provided by screws located and the forward and rear ends of plates 16 threadedly engaging body 14.

Figure 2:
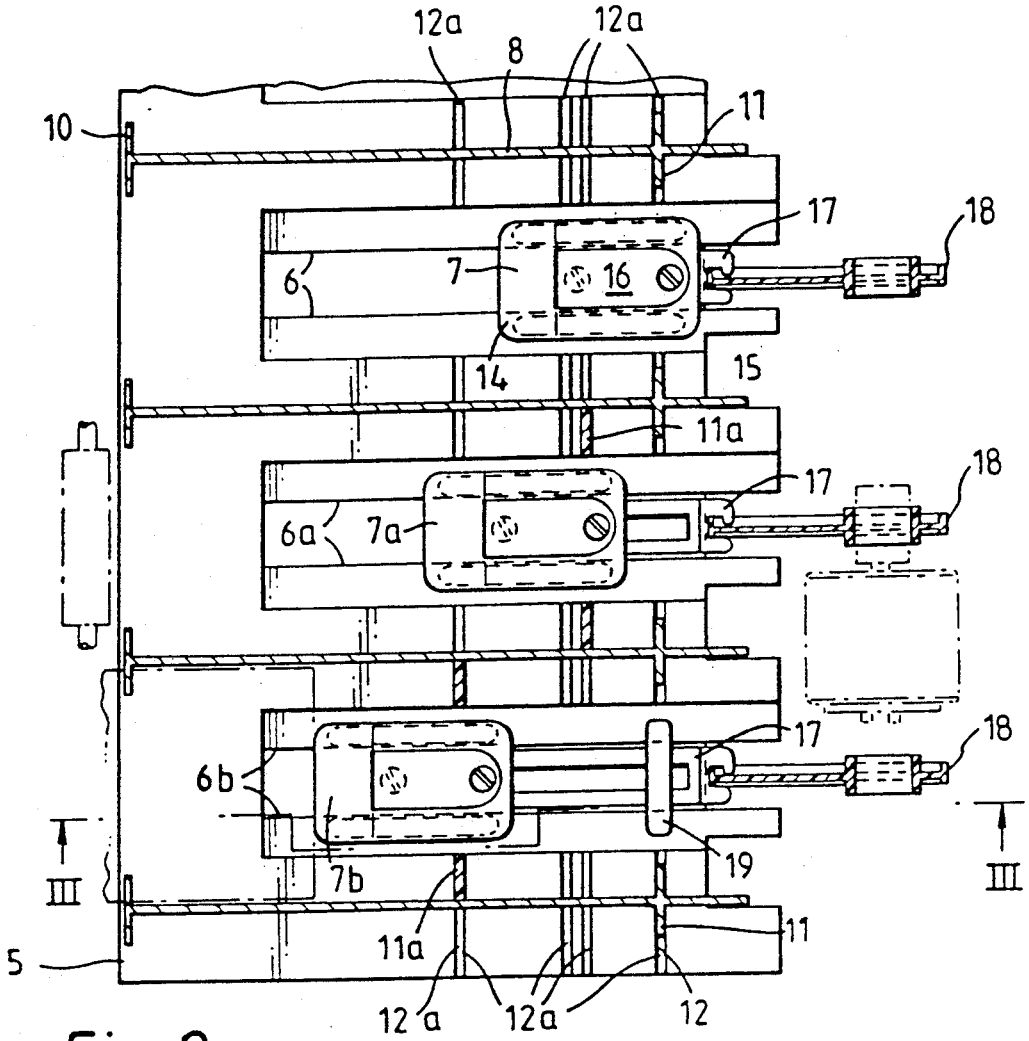
FIG. 2 is a plan view of the card dispensing device according to the invention for a plurality of columns of cards.
Figure 3:
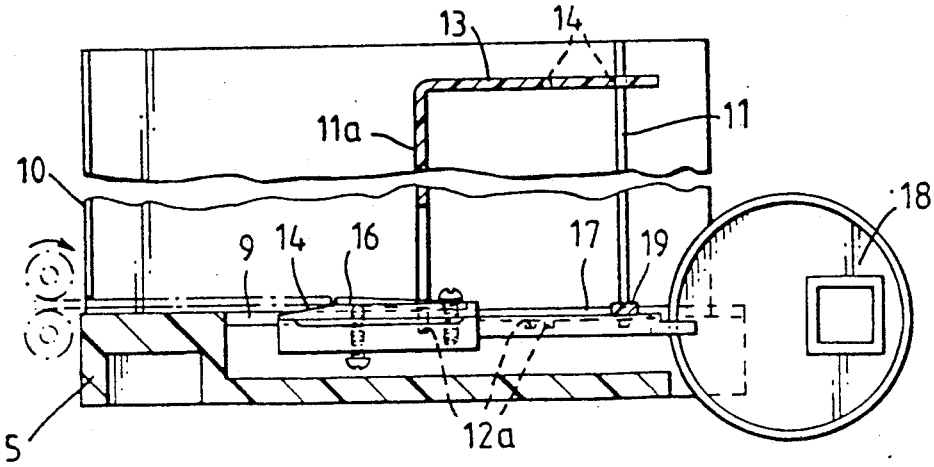
FIG. 3 is a cross-sectional view of the device illustrated in FIG. 2 taken along line III—III of FIG. 2.

Each pusher plate is provided at the rear end of body 14 with a rearwardly extending arm 17. As shown in FIG. 2 the pusher plates illustrated are provided with arms of different lengths to dispense cards of different lengths. The rear end of each arm 17 is provided with means to engage a cam 18 each cam 18 being driven independently by an electric motor preferably through gear means to reciprocate the connected pusher plate to eject the lowermost card in the column located above that pusher plate. One such motor is illustrated in outline in FIG. 2. Alternatively, the pusher plates may be constructed with arms of a constant length and operated by cams of different size to achieve the same result. As illustrated in FIGS. 2 and 3 pusher plate 7*b* is provided with a cross-bar 19 on its arm to support the arm on guides 6*b*.

It will be obvious from the above description that a pusher plate assembly according to the invention can be arranged to dispense cards or tickets of different lengths and may also be adjusted to dispense cards or tickets of different thicknesses. Moreover, the assembly is such that the assembly can be easily altered to vary the lengths and thicknesses of the cards dispensed by an individual card or ticket dispensing machine. The assembly can also be adjusted to dispense cards of different thicknesses.

What is claimed is:

1. A card or ticket dispensing device for a coin operated card or ticket dispensing machine, said device comprising a pusher plate support assembly having a plurality of parallel, substantially horizontal spaced pairs of guides, a plurality of pairs of spaced parallel side walls for slidably retaining a column of vertically superposed substantially horizontal cards or tickets for downward movement of said cards or tickets, each said pair of guides being positioned between a respective pair of spaced parallel side walls, a plurality of rear walls, each rear wall being positioned between a respective pair of side walls and adjustably positionable therealong for slidably retaining cards or tickets of different lengths, and a plurality of card or ticket pusher plate assemblies detachably and slidably supported on a respective said pair of guides for horizontal reciprocatory movement along said pair of guides and including a pusher plate having guide engaging means for engaging a respective pair of guides, a forwardly facing and upwardly extending flange for engaging the rear edge of a lowermost card or ticket stored in the column above said pair of guides and an arm extending rearwardly of said pusher plate, said plurality of pusher plate assemblies having respective said arms of different lengths and which are coupled to respective actuators each actuator having an identical reciprocal stroke length to reciprocate a respective pusher plate assembly to eject the lowermost card or ticket from the column disposed above said respective pusher plate assembly, the combination of the differing arm lengths of the pusher plate assemblies and the identical reciprocal stroke of the actuators cards or tickets of different lengths to be ejected from different columns.

2. A card or ticket dispensing device as claimed in claim 1, wherein each said upwardly extending flange is the forward edge of a vertically adjustable plate mounted on the upper surface of each said pusher plate.

3. A card or ticket dispensing device as claimed in claim 2, wherein said adjustable plate is adjusted by screw threaded means.

4. A card or ticket dispensing device as claimed in claim 1, wherein said spaced, parallel side walls for slidably retaining said columns of cards or tickets are detachably mounted on said pusher plate support assembly.

5. A card or ticket dispensing device as claimed in claim 4, wherein each said pair of side walls includes a pair of opposed rear ribs and said rear wall for each column is adapted to be adjustably positioned by engagement with the rear ribs of the associated pair of side walls.

6. A card or ticket dispensing device for a coin operated card or ticket dispensing machine, said device comprising a pusher plate support assembly having a plurality of parallel, substantially horizontal spaced pairs of guides, a plurality of pairs of spaced parallel side walls for slidably retaining a column of vertically superposed substantially horizontal cards or tickets for downward movement of said cards or tickets, each of said pair of guides being positioned between a respective pair of spaced parallel side walls;

a plurality of rear walls, each rear wall being positioned between a respective pair of side walls and adjustably positionable therealong for slidably retaining cards or tickets of different lengths, and a plurality of card or ticket pusher plate assemblies detachably and slidably supported on a respective said pair of guides for horizontal reciprocatory movement along said pair of guides and including a pusher plate having guide engaging means for engaging a respective pair of guides, a forwardly facing and upwardly extending flange for engaging the rear edge of a lowermost card or ticket stored in the column above said pair of guides and an arm extending rearwardly of said pusher plate, said plurality of pusher plate assemblies having respective arms of equal length and which are coupled to respective actuators having different reciprocal stroke lengths to reciprocate the respective pusher plate assembly to eject the lowermost card or ticket from the column disposed above the pusher plate assembly, the combination of the equal lengths of the respective arms and the different reciprocal stroke lengths of the respective actuators allowing cards or tickets of different lengths to be ejected from different columns.

7. A card or ticket dispensing device as claimed in claim 6, wherein each said upwardly extending flange is the forward edge of a vertically adjustable plate mounted on the upper surface of each said pusher plate.

8. A card or ticket dispensing device as claimed in claim 6, wherein said adjustable plate is adjusted by screw threaded means.

9. A card or ticket dispensing device as claimed in claim 8, wherein said spaced, parallel side walls for slidably retaining said columns of cards or tickets are detachably mounted on said pusher plate support assembly.

10. A card or ticket dispensing device as claimed in claim 9, wherein said pair of side walls includes a pair of opposed rear ribs and said rear wall for each column is adapted to be adjustably positioned by engagement with the rear ribs of the associated pair of side walls.

11. A card or ticket dispensing device as claimed in claim 6, wherein said actuators for the card or ticket pusher plate assemblies are cams, the size and eccentricity of which may be selected to eject cards or tickets of different lengths from different columns.

* * * * *

UNITED STATES PATENT AND TRADEMARK OFFICE

CERTIFICATE OF CORRECTION

PATENT NO. : 5,074,432

DATED : December 24, 1991

INVENTOR(S) : Barry Andrew Robert MacNamara

It is certified that error appears in the above-identified patent and that said Letters Patent is hereby corrected as shown below:

Title page, item [73]

Add assignment data as follows:

Assignee: TDM Pty Ltd
Queensland, AUSTRALIA

Col. 4, line 39,
claim 1, after "actuators" insert --allowing--.

Signed and Sealed this

Twentieth Day of April, 1993

*Attest:*

MICHAEL K. KIRK

*Attesting Officer*

*Acting Commissioner of Patents and Trademarks*